US010343048B2

(12) United States Patent
Vaughn

(10) Patent No.: US 10,343,048 B2
(45) Date of Patent: Jul. 9, 2019

(54) GOALIE BLOCKER GLOVE

(71) Applicant: Michael A. Vaughn, Oxford, MI (US)

(72) Inventor: Michael A. Vaughn, Oxford, MI (US)

( * ) Notice: Subject to any disclaimer, the term of this patent is extended or adjusted under 35 U.S.C. 154(b) by 486 days.

(21) Appl. No.: 15/130,008

(22) Filed: Apr. 15, 2016

(65) Prior Publication Data

US 2016/0303463 A1 Oct. 20, 2016

Related U.S. Application Data

(60) Provisional application No. 62/147,621, filed on Apr. 15, 2015.

(51) Int. Cl.
*A63B 71/14* (2006.01)
*A63B 102/24* (2015.01)

(52) U.S. Cl.
CPC ..... *A63B 71/143* (2013.01); *A63B 2102/24* (2015.10); *A63B 2210/50* (2013.01); *A63B 2225/09* (2013.01)

(58) Field of Classification Search
CPC ..... A63B 71/143
USPC ..... 2/16, 19, 161.1, 161.6
See application file for complete search history.

(56) References Cited

U.S. PATENT DOCUMENTS 4,700,404 A * 10/1987 Potvin ..... A63B 71/143 2/16
5,107,544 A * 4/1992 Capatosto ..... A63B 71/143 2/16
5,435,008 A * 7/1995 Shane ..... A63B 71/143 2/16
5,564,122 A * 10/1996 Wagner ..... A63B 71/143 2/16
2009/0106875 A1* 4/2009 Christopher ..... A63B 71/1225 2/161.1

* cited by examiner

*Primary Examiner* — Katherine M Moran
(74) *Attorney, Agent, or Firm* — Foster Swift Collins & Smith PC; Zachary W. Behler

(57) ABSTRACT

The present invention provides a goalie blocking glove that features a non-binding front blocking board surface that incorporates a carbon fiber front layer over the ultra-high density internal foam core, for lighter weight and added protection under extreme impacts. An adjustment mechanism is also included in the blocker glove, to allow the goalie to customize the fit of the inner glove to his or her individual hand size.

19 Claims, 4 Drawing Sheets

GOALIE BLOCKER GLOVE

CROSS REFERENCE TO RELATED APPLICATIONS

This application claims priority to U.S. provisional application Ser. No. 62/147,621, entitled "Goalie Blocker Glove," filed Apr. 15, 2015.

FIELD OF INVENTION

The present invention is in the field of blocker gloves for ice hockey goalies.

BACKGROUND

In ice hockey, the goaltender, also known colloquially as the "goalie", is the player who defends his or her team's goal net by stopping shots of the puck from entering his or her team's net, thus preventing the opposing team from scoring. Because of the power of shots, the goaltender wears special equipment designed to protect the body from direct impact of the puck. Special goaltending equipment is subject to specific regulations. For example, many other professional and non-professional ice hockey leagues adhere to equipment size regulations based on International Ice Hockey Federation rules. The National Hockey League ("NHL") specifies maximum dimensions of goaltending equipment to prevent goalies from having an unfair puck blocking advantage. Current NHL rules for blocking gloves limit padding attached to the back or forming part of the goaltender's blocking glove to eight inches (8") in width and fifteen inches (15") in length at any point. Further, the blocking glove must be rectangular in shape. The flap protecting the thumb and wrist must be fastened to the blocker and must follow the contour of the thumb and wrist. This thumb protection must not exceed seven inches (7") in extreme length when measured from the top of the blocking surface. Further, raised ridges are not to be added to any portion of the blocking glove. All goaltenders must use one of each of a blocking glove and catching glove that meet League-approved sizing specifications.

SUMMARY

The present invention provides a goalie blocking glove that features a non-binding front blocking board surface that incorporates a carbon fiber front layer over the ultra-high density internal foam core, for lighter weight and added protection under extreme impacts. The hand location on the board base is carefully designed to provide for balance and feel and to optimize stick placement during paddle down moves on the ice. The bottom edge of the board base is beveled to allow the catching glove to get tight to the ice and to reduce weight on the lower end of the catching glove for improved balance. The top section of the blocking board is curved and laced through the body of the catching glove; this secures the blocking surface to the inner foam core, providing more consistent deflection and control when making saves. New floating cuff functions provide greater range of motion for the wrist and aid in improving the glove angle to the puck. Large finger protectors with a wide base for stability wrap the finger sides and ends for more complete protection. The index finger has a double layer inside edge padding for additional protection.

BRIEF DESCRIPTION OF THE DRAWINGS

The Description of Exemplary Embodiments will be better understood with reference to the following figures.

DETAILED DESCRIPTION OF EXEMPLARY EMBODIMENTS

Figure 1:
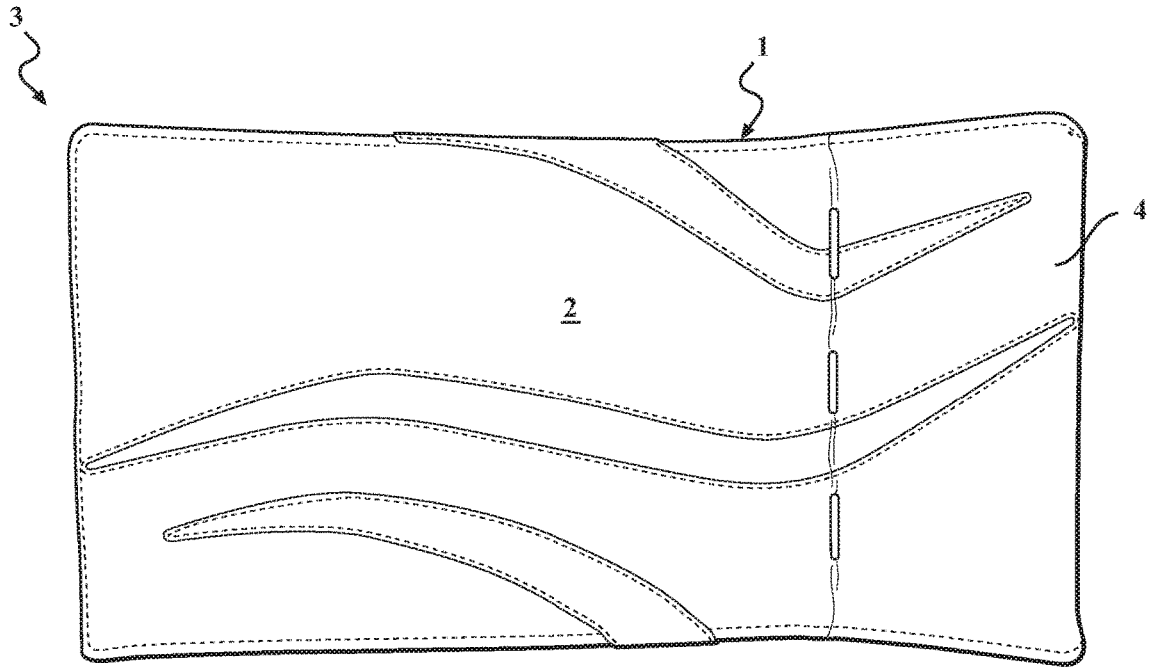
FIG. 1 is a top view of the inventive blocker glove.
Figure 2:
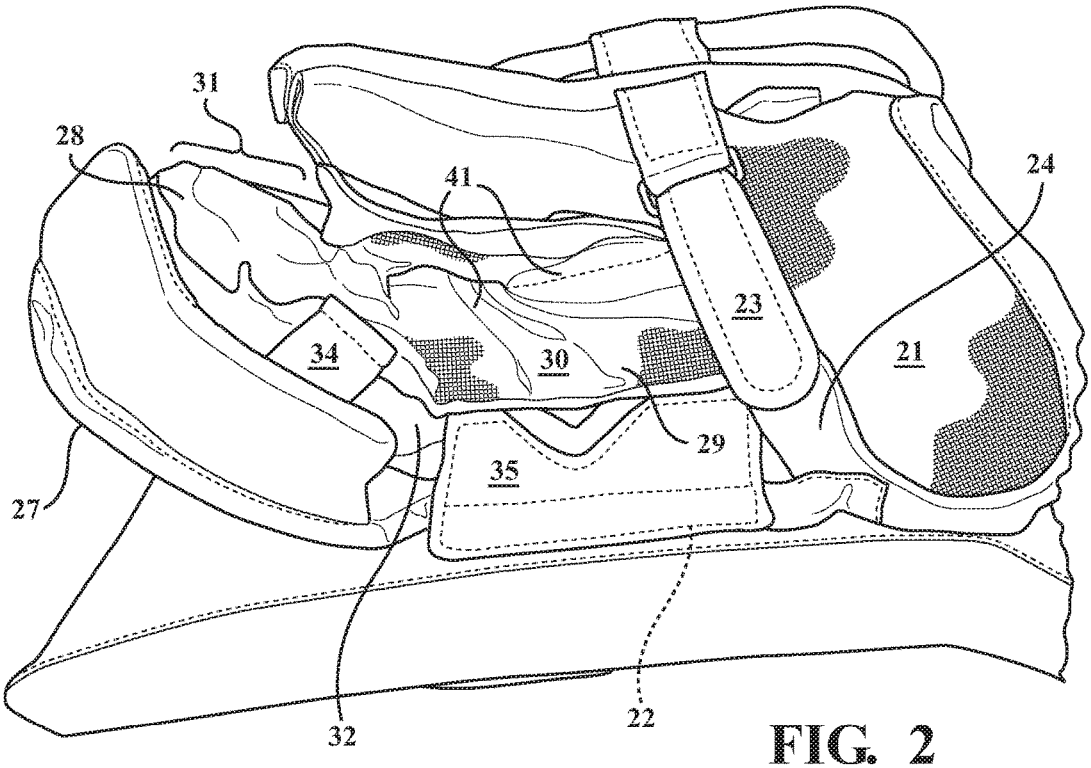
FIG. 2 is a pinky side view of the inventive blocker glove.
Figure 3:
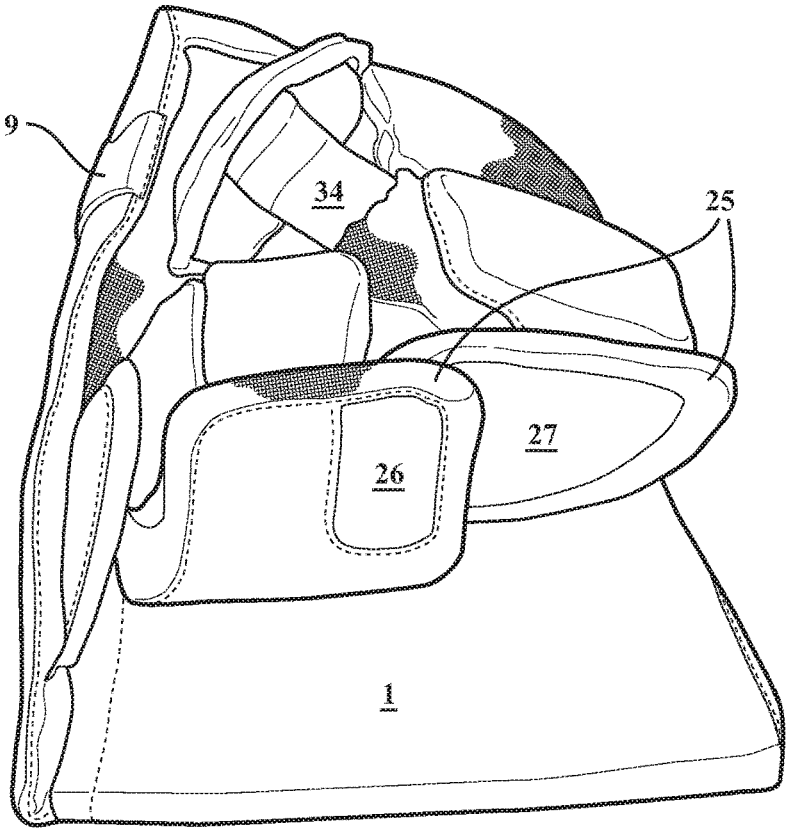
FIG. 3 is a fingertip side view of the inventive blocker glove.
Figure 4:
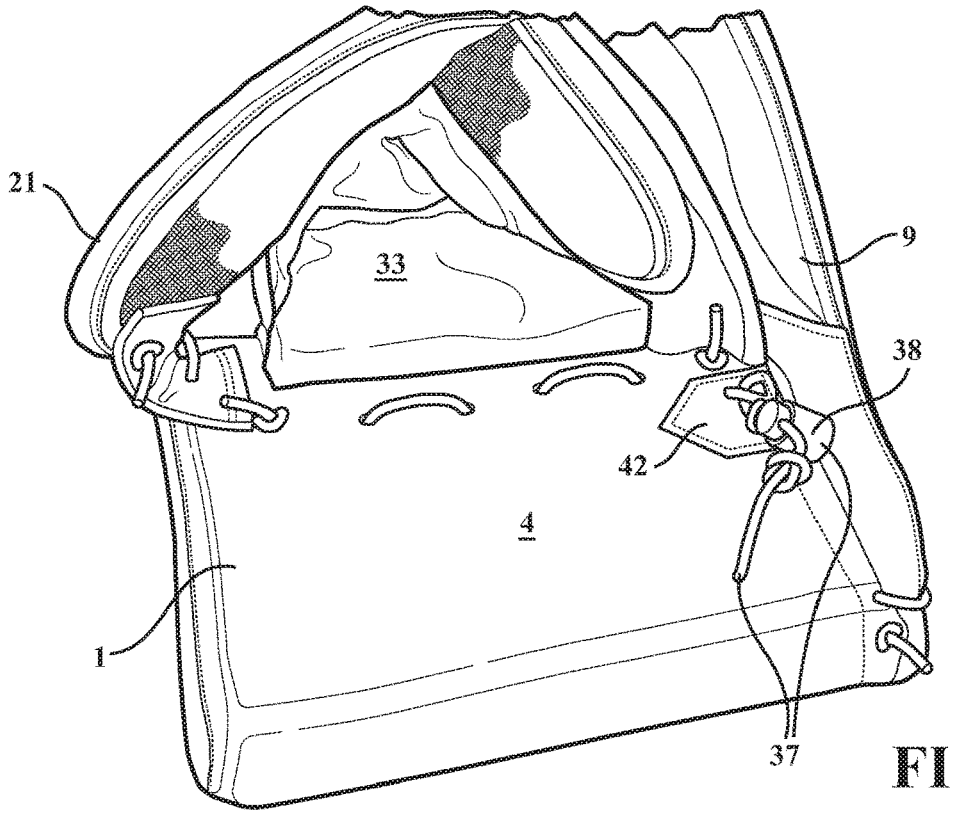
FIG. 4 is a cuff side view of the inventive blocker glove.
Figure 5:
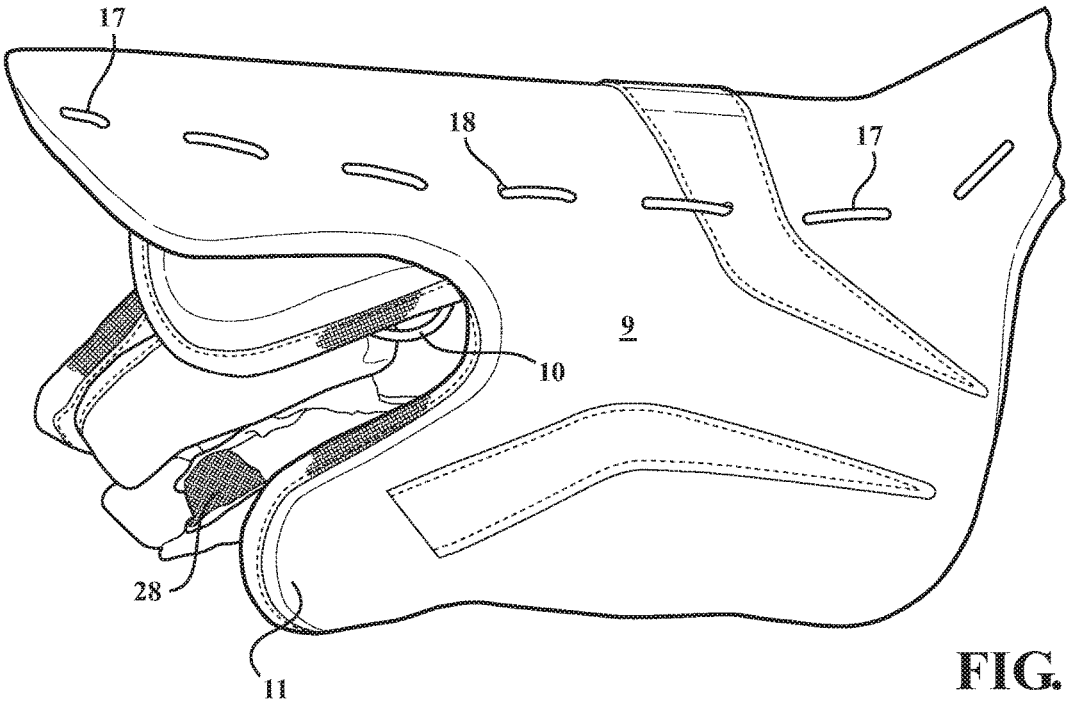
FIG. 5 is a thumb side view of the inventive blocker glove.
Figure 6:
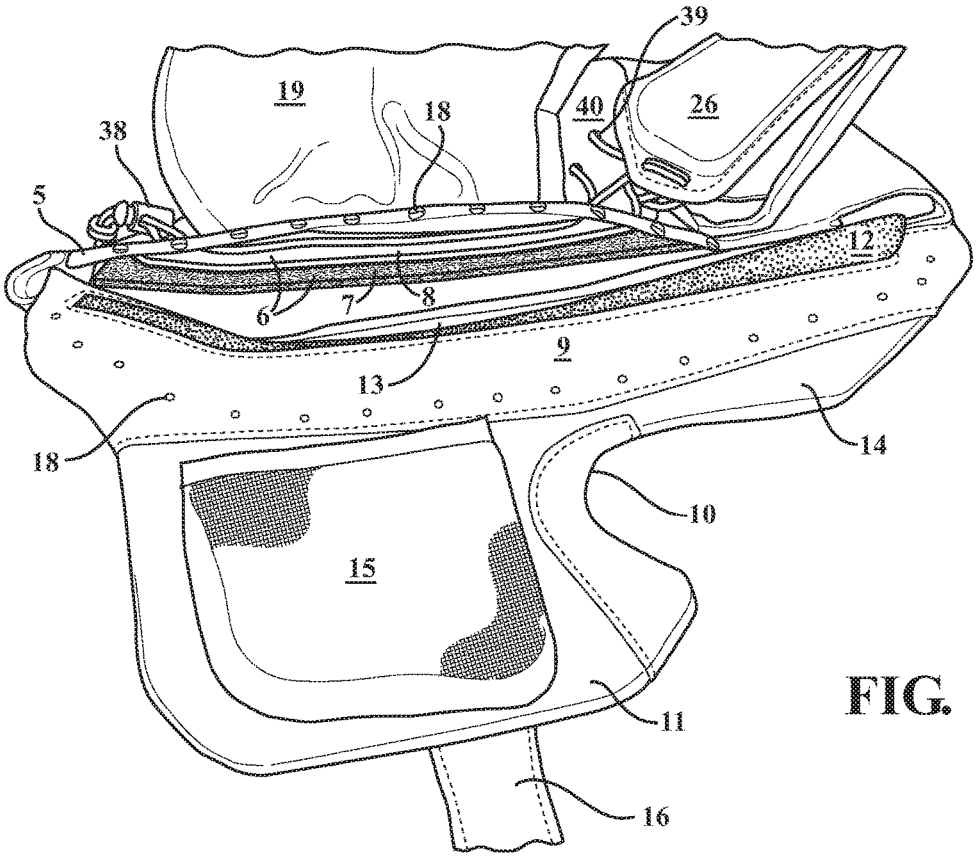
FIG. 6 is a thumb side view showing the interior of the inventive blocker glove.
Figure 7:
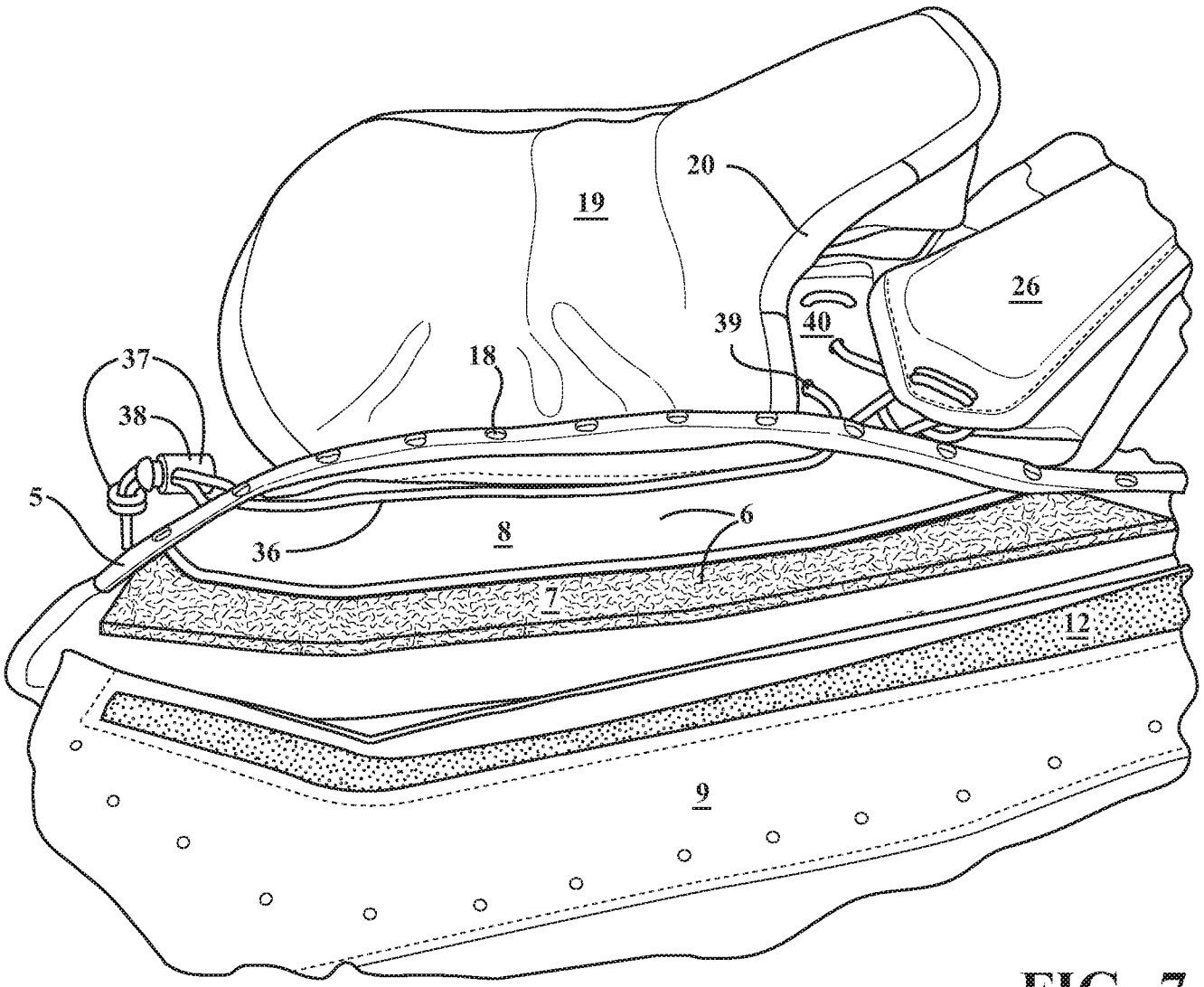
FIG. 7 is a bottom view of the inventive blocker glove.

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

The front blocking board 1 is designed to protect the goalie's hand and wrist from impacts from pucks. The front blocking board 1 consists of a hand and wrist plate 2 that covers the top of the hand and wrist of the goalie while the glove 3 is in use. In the preferred embodiment, the front blocking board 1 is rectangularly shaped. The wrist end 4 of the front blocking board 1 is flared upward away from the goalie's wrist to enhance puck blocking capacity. In the preferred embodiment, the front blocking board 1 is constructed of several layers of material. The outer shell 5 of the front blocking board 1 may be constructed of synthetic leather or similar material. The inner layers 6 may include foam or carbon fiber to enhance the padding and/or stiffness of the front blocking board 1. In the preferred embodiment, the front blocking board 1 has a thick ultra-high density foam layer 7 reinforced with carbon fiber 8, providing increased protection to the top of the hand while enlarging the coverage and blocking area of the glove 3.

A side shield 9 is connected to the thumb side of the front blocking board 1. The side shield 9 is designed to protect the pointer finger, thumb and inner wrist of the goalie while the glove 3 is in use. A cut out 10 is placed in the side shield 9 in order to allow the goalie's stick to move through the thumb shield 11 and be grasped by the goalie's hand. The side shield 9 may be constructed of several layers. In the preferred embodiment, the side shield 9 has a thick ultra-high density foam layer 12 reinforced with polyethylene plastic 13 providing increased protection to the side of the hand while enlarging the coverage and blocking area of the glove 3. The outer layer 14 of the side shield 9 may be constructed of synthetic leather or other similar material. Optionally, an additional soft thumb pad 15 may be inserted on the inside of the side shield 9. In the preferred embodiment, this thumb pad 15 is constructed of soft foam and is removeably attached to the inside of the thumb shield 11 using a hook and loop fastener 16 or similar attachment method. The side shield 9 may be stitched to the front blocking board 1 and additionally connected, using laces 17 threaded through holes 18 in the top of the side shield 8 and the inside edge of the front blocking board 1.

An additional thumb and wrist pad 19 may be added. The thumb and wrist pad 19 is added to protect the inner wrist and thumb of the goalie when the blocker glove 3 is in use. The thumb and wrist pad 19 may be constructed of any material suitable for blocking pucks, including nylon, synthetic leather and foam padding. In the preferred embodiment, several materials are used such as foam and nylon in order to provide specific cushioning characteristics. The constituent parts of the thumb and wrist pad 19 are typically held together using stitching 20. The thumb and wrist pad 19 is also attached to a lower wrist guard 21, which may be constructed out of similar materials. The lower wrist guard 21 is shaped to cover the bottom of the goalie's wrist and attaches to the front blocking board 1 on both sides of the wrist. In the preferred embodiment, this attachment is accomplished using stitching and/or laces 22. The lower wrist guard 21 also has a wrist strap 23 that may be used to tighten the wrist portion of the blocker glove 3 around the goalie's wrist. In the preferred embodiment, the wrist strap 23 is equipped with a hook and loop fastener 24 that may be adjustably tightened around the goalie's wrist.

Finger pads 25 may also be added to the blocker glove 3. In the preferred embodiment, two finger pads 25 are included. The pointer finger pad 26 surrounds the thumb side of the goalie's pointer finger and the point of the pointer finger, as well as the top. The second finger pad 27 covers the outside of the goalie's pinky finger and the top of the pinky, ring, and middle fingers, as well as the tip of the pinky, ring, and middle fingers. The finger pads 25 can be attached to an adjustable inner glove 28 of the blocker glove 3.

The adjustable inner glove 28 may be constructed of any material suitable for conforming to the goalie's hand. In the preferred embodiment, nylon mesh 29 is used to aid in ventilation of the hand while the blocker glove 3 is in use. The palm 30 is preferably constructed of a material to improve gripping of the goalie's stick. In the preferred embodiment, the palm features MSH≠3 base material, with a grip layer for added stick control. The palm 30 design is optimized for the hand in the grip position, with each finger having a pre-shaped curve 31 to the design. The palm 30 also is equipped with mesh gussets 32 for flexibility and air flow, and a cushion pad 33 on the back hand to further increase protection. The inner glove 28 is attached to the finger pads 25 using elastic straps 34, so that the inner glove 28 has greater mobility than the finger pads 25. In the preferred embodiment, one elastic strap 34 is connected to the pointer finger of the inner glove 25 and the pointer finger pad 26. Another elastic strap 34 is connected to the middle finger of the inner glove 25 and the pinky, ring and middle finger pad 27. A third elastic strap is attached from the pinky finger of the inner glove 25 and to the second finger pad 27.

The inner glove 28 is connected to the front blocking board 1 using stitching. In the preferred embodiment, pieces of synthetic leather 35 are used to reinforce this connection and provide a medium to stitch through. One synthetic leather connection strip 35 is located on the pinky side of the goalie's hand. Another synthetic leather connection strip 35 is located on the thumb side of the inner glove 28.

An adjustment mechanism 36 is also included in the blocker glove 3, to allow the goalie to customize the fit of the inner glove 28 to his or her individual hand size. Adjustment laces 37 are run from the wrist end 4 of the front blocking board 1, through the front blocking board 1, to the portion of the inner glove 28 between the thumb and pointer finger. A cinch clip 38 is provided at the rear of the front blocking board 1. The cinch clip 38 may be used to adjust the amount of lacing 37 used to tighten the inner glove 28 around the goalie's hand. The front of the adjustment mechanism 36 includes two holes 39 for the lacing 37 that connect to a synthetic leather anchor plate 40. The anchor plate 40 is stitched to the front blocking board 1 and the inner glove 28 and facilitates the connection of the adjustment laces 37 to the inner glove 28. A lace 37 is routed through the front blocking board 1 near the web of the pointer finger and thumb of the inner glove 28, routed into the anchor plate 40, and then through pockets 41 in the palm of the inner glove 28. The adjustment lace 37 is then anchored into a second anchor plate 42 on the pinky side of the inner glove 28. When the goalie pulls on the wrist end of the adjustment lacing 37, pressure is applied to the palm of the inner glove 28 via the laces 37. The cinch clip 38 can then be used to fix the amount of pressure applied by the adjustment laces 37 to the palm of the goalie's hand.

The invention claimed is:

1. A goalie blocking glove comprising:
- a front blocking board with a wrist end;
- an inner glove with at least a thumb and pointer finger;
- a side shield that protects the pointer finger and thumb of the inner glove while the glove is in use; and
- a means for adjusting the fit of the inner glove comprising:
  - at least one adjustment lace that runs from the wrist end of the front blocking board to a portion of the inner glove between the thumb and pointer finger; and
  - a cinch clip secured to the adjustment lace that adjusts the amount of lacing to tighten the inner glove.

2. The goalie blocking glove of claim 1, wherein the means for adjusting the fit of the inner glove further comprises:
- a plurality of holes in the front blocking board for the lacing; and
- at least one synthetic leather anchor plate that facilitates the connection of the adjustment laces to the inner glove.

3. The goalie blocking glove of claim 2, wherein the means for adjusting the fit of the inner glove further comprises:
- a palm of the inner glove;
  - thumb side of the inner glove;
  - pinky side of the inner glove;
  - a plurality of pockets in the palm of the inner glove;
  - a first synthetic leather anchor plate stitched to the front blocking board and the thumb side of the inner glove; and
  - a second synthetic leather anchor plate stitched to the front blocking board and the pinky side of the inner glove.

4. The goalie blocking glove of claim 3, wherein said at least one adjustment lace is routed through the front blocking board into said first anchor plate, and then through said pockets in the palm of the inner glove and is then anchored into said second anchor plate.

5. The goalie blocking glove of claim 1, wherein front blocking board further comprises:
- an outer shell;
- a plurality of inner layers; and
- at least one inner layer constructed of carbon fiber that enhances the stiffness of the front blocking board.

6. The goalie blocking glove of claim 5, wherein the inner layers further comprise:
- an ultra-high density foam layer.

7. The goalie blocking glove of claim 1, wherein said side shield further comprises:

an outer shell;

a plurality of inner layers to enhance the stiffness of the side shield.

8. The goalie blocking glove of claim 7, wherein the inner layers further comprise:

an ultra-high density foam layer; and a polyethylene plastic layer.

9. The goalie blocking glove of claim 7, wherein side shield further comprises:

an inside surface that faces the thumb of the inner glove when in use; and a soft thumb pad located on the inside of the side shield.

10. The goalie blocking glove of claim 9, wherein said soft thumb pad is removably attached to the side shield.

11. The goalie blocking glove of claim 10, wherein the thumb pad is removeably attached using a hook and loop fasteners.

12. The goalie blocking glove of claim 7, wherein said side shield further comprises:

a thumb shield.

13. The goalie blocking glove of claim 12, wherein said side shield further comprises:

a cut out placed in the side shield that allows the goalie's stick to move through the thumb shield.

14. The goalie blocking glove of claim 1, further comprising:

a thumb and wrist pad.

15. The goalie blocking glove of claim 14, wherein the thumb and wrist pad is attached to the front blocking board on both sides of the inner glove.

16. The goalie blocking glove of claim 14, further comprising:

a pointer finger pad that covers a portion of a thumb side of the inner glove; and a second finger pad that covers a portion of a pinky side of the inner glove.

17. The goalie blocking glove of claim 14, wherein the inner glove is attached to the finger pads by straps constructed of elastic.

18. The goalie blocking glove of claim 1, wherein said side shield is stitched to the front blocking board.

19. The goalie blocking glove of claim 18, wherein said side shield is additionally connected, using laces threaded through holes in a top of the side shield and an inside edge of the front blocking board.

* * * * *